US007005045B1

(12) United States Patent
Halmschlager et al.

(10) Patent No.: US 7,005,045 B1
(45) Date of Patent: Feb. 28, 2006

(54) BELT FOR MACHINES FOR PRODUCING MATERIAL WEBS AND PROCESS OF PRODUCING THE BELT

(75) Inventors: Günter Halmschlager, Krems (AT); Walter Holzer, Hofstetten (AT)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/482,263

(22) Filed: Jan. 13, 2000

(30) Foreign Application Priority Data

Jan. 13, 1999 (DE) ..... 199 00 989

(51) Int. Cl.
*D21F 7/12* (2006.01)

(52) U.S. Cl. ..... 162/375; 162/361; 162/901; 162/902; 428/192; 139/425 A; 245/4; 34/116

(58) Field of Classification Search ..... 162/204–207, 162/358.2, 358.4, 900–904, 348, 306, 361, 162/362, 375, 376, 377; 139/383 A, 425 A; 34/111–123; 428/192–194, 221, 357; 442/60, 442/61, 189, 192–195, 228, 229; 245/4; 198/698, 699, 778, 844.1–853
See application file for complete search history.

(56) References Cited

U.S. PATENT DOCUMENTS 340,335 A * 4/1886 Lindsay ..... 34/116
1,794,624 A * 3/1931 Kastner ..... 139/425 A
1,873,949 A * 8/1932 Williams ..... 34/116
1,925,917 A * 9/1933 Chaolon ..... 428/132
2,110,388 A * 3/1938 Asten ..... 139/383 A
2,718,791 A * 9/1955 Hose et al. ..... 245/10
3,077,925 A * 2/1963 Perkins et al. ..... 162/367
3,518,104 A * 6/1970 Plyler ..... 249/115
3,523,867 A * 8/1970 MacBean ..... 162/348
3,531,371 A * 9/1970 Jordansson et al. ..... 162/298
3,612,256 A * 10/1971 Limbach et al. ..... 139/425 R
3,652,390 A * 3/1972 Peterson ..... 162/303
3,968,296 A * 7/1976 Nopper et al. ..... 442/8
4,015,038 A * 3/1977 Romanski et al. ..... 442/4
4,224,372 A * 9/1980 Romanski ..... 442/187
4,251,928 A 2/1981 Rotar et al.

(Continued)

FOREIGN PATENT DOCUMENTS

DE 2922025 12/1979

(Continued)

*Primary Examiner*—Eric Hug
(74) *Attorney, Agent, or Firm*—Greenblum & Bernstein, P.L.C.

(57) ABSTRACT

A belt for a material web producing machine and a process of producing the belt. The belt includes a plurality of long-chain strength supports arranged to form interstices and a filler at least partially filling the interstices. The process includes forming a sheet from a plurality of long-chain strength supports with the sheet including a plurality of interstices disposed between the long-chain strength supports, and filling at least a portion of the interstices with a filler.

51 Claims, 1 Drawing Sheet

U.S. PATENT DOCUMENTS

| | | | | | |
|---|---|---|---|---|---|
| 4,482,430 | A | * | 11/1984 | Majaniemi | 162/358.4 |
| 4,486,490 | A | * | 12/1984 | Patz et al. | 442/219 |
| 4,944,820 | A | * | 7/1990 | McCarten | 156/154 |
| 5,196,092 | A | * | 3/1993 | Stigberg | 162/358.4 |
| 5,212,010 | A | * | 5/1993 | Curzio et al. | 442/187 |
| 5,238,537 | A | * | 8/1993 | Dutt | 162/358.4 |
| 5,314,325 | A | * | 5/1994 | Bosler | 425/384 |
| 5,449,548 | A | * | 9/1995 | Bowen, Jr. | 442/195 |
| 5,506,033 | A | * | 4/1996 | Smith | 428/192 |
| 5,597,646 | A | * | 1/1997 | Keller | 442/195 |
| 5,651,394 | A | * | 7/1997 | Marchand | 139/383 A |
| 5,731,059 | A | | 3/1998 | Smith et al. | |
| 5,753,085 | A | | 5/1998 | Fitzpatrick | 162/358.4 |
| 6,251,331 | B1 | * | 6/2001 | Ampulski et al. | 264/257 |
| 6,294,485 | B1 | * | 9/2001 | Hodson et al. | 442/85 |

FOREIGN PATENT DOCUMENTS

| | | | |
|---|---|---|---|
| DE | 3235468 | | 3/1989 |
| DE | 3231039 | | 2/1990 |
| DE | 4026339 | | 3/1991 |
| DE | 4115816 | | 11/1992 |
| DE | 29510307 | | 12/1996 |
| EP | 0006316 | | 1/1980 |
| GB | 1058616 | | 2/1967 |
| GB | 2 128 548 A | * | 5/1984 |
| WO | 97/14846 | | 4/1997 |

* cited by examiner

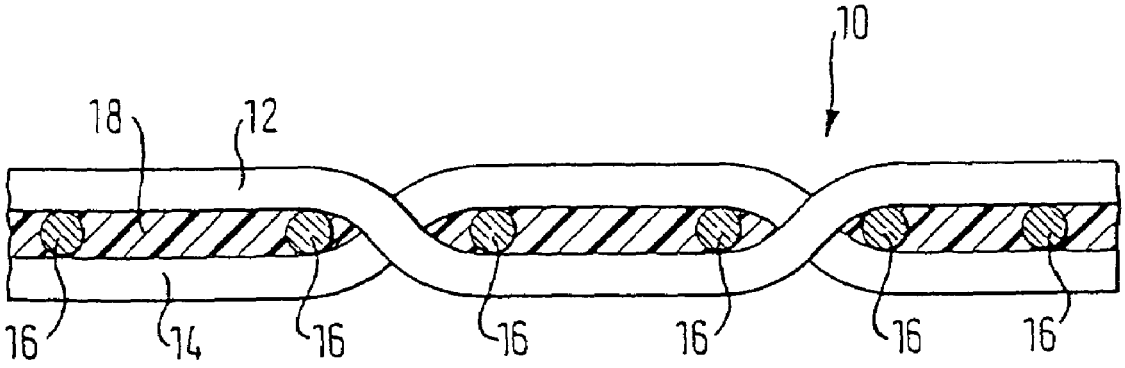
10
18
12
16
14
16
16
16
16
16

BELT FOR MACHINES FOR PRODUCING MATERIAL WEBS AND PROCESS OF PRODUCING THE BELT

CROSS-REFERENCE TO RELATED APPLICATIONS

The present application claims priority under 35 U.S.C. § 119 of German Patent Application No. 199 00 989.9, filed on Jan. 13, 1999, the disclosure of which is expressly incorporated by reference herein in its entirety.

BACKGROUND OF THE INVENTION

1. Field of the Invention

The present invention concerns a belt for machines for producing material webs, particularly paper webs. The invention also concerns a process of producing the belt.

2. Discussion of Background Information

In paper machines, the use of screens made of metallic or plastic filaments for supporting a paper web is known. Due to their permeability, such screens cannot be used as sealing belts which, in drying areas of paper machines, serve to seal off a drying space which borders on a heated surface, such as the surface of a drying cylinder. For such purposes, all-metal belts are used which are very difficult to handle and which, particularly because of their great weight and low flexibility, place an upper limit on the belt velocity and thus the operating speed of the paper machine. An additional disadvantage of all-metal belts is that their width, which amounts to approximately 2 m maximum, is limited for reasons of manageability.

SUMMARY OF THE INVENTION

The invention provides a belt of the aforementioned type, as well as a process for producing such a belt, which is easy to manage and in particular can be used as a sealing belt.

The belt is made of a compound material which includes a sheet material prepared from preferably long-chain strength supports, in which interstices between the strength supports are at least partially filled with a filler.

Because of the linkage of strength supports and filler, the weight of the belt according to the invention can be reduced in comparison to all-metal belts without impairing the stability and strength of the belt. Furthermore, the belt is significantly more flexible as a result of the compound material according to the invention. In principle, the belt according to the invention can be manufactured in any desired width, which can amount to more than 2 m. A further advantage lies in the fact that the production costs are lower than for all-metal belts. The invention additionally enables the surface composition and in particular the thermal conductivity of the belt, and thus the heat transfer properties of this belt, to be purposely adjusted by altering the amount of strength support on the overall surface. On the whole, a belt is obtained from the invention which is easily handled, economical, and versatile.

In one embodiment of the invention, the compound material is at least substantially impermeable to fluids such as a liquid.

The belt according to the invention can moreover be used as a sealing belt in drying areas, for example, of paper machines. The material which fills the interstices in the sheet material prevents the uncontrolled escape of moisture into the surroundings from the material or paper web being dried, which web is led through a drying area which is bounded by the heated surface or a drying cylinder and the belt according to the invention.

In another embodiment of the invention, beadlike protuberances, which are preferably formed from the strength supports of the sheet material, are provided in the edge regions.

The belt according to the invention may be provided with integrated sealing beads which can be formed during manufacture of the sheet material. The sealing beads, which can be made of metal or plastic, seal the aforementioned drying space for the material web to be dried off from its surroundings along with the heated surface and the region of the belt lying between the sealing beads. As a result, separate sealants are therefore not required according to the invention.

In another embodiment of the invention, a surface which is at least substantially sealed is formed on at least one side of the strength supports.

By utilizing a sealed surface, large-surface contact is facilitated between the material used for the strength supports and the heated surface of, for example, a drying device, such as a drying cylinder, or a cooling fluid. When a material of high thermal conductivity, especially metal, is used for the strength supports, the thermal conductivity of the belt and thus the transfer of heat through the belt can be enhanced and even maximized. It is also possible to form the belt with one of the strength supports on each of the two sides of the belt in order to provide at least a substantially sealed surface. In this manner, when metal is used for the strength supports, heat transfer properties of the belt according to the invention can be obtained which at least approximately correspond to heat transfer properties of an all-metal band.

In another embodiment of the invention, the strength supports are interwoven with one another.

The sheet material formed hereby from a fabric can be manufactured and targeted for a specific use with comparative ease, as well as reproducibly provided with desired characteristics. In particular, by selecting a specific weaving process, the amount of strength supports on the overall surface of the belt, and thus the heat transfer properties of such a belt, can be purposefully influenced.

The invention also provides that a sheet material is prepared from preferably long-chain strength supports, especially metallic filaments, and interstices between the strength supports are filled at least partially with a filler, in particular with plastic.

In a preferred embodiment of the invention, the sheet material is dipped in liquid filler.

The sheet material is thus saturated to some degree with the filler, such that the interstices are filled in a particularly simple and rapid manner, and the liquid imperviousness of the compound material, which is formed by the strength supports and by the filler which is cured in its ultimate state, can be produced.

After submersion in the filler, excess material covering the surfaces of the sheet material can be scraped off in order to expose the strength supports which form the surface in question. Here, the sheet material can be treated such that the strength supports and the filler located between the strength supports form at least an approximately smooth surface.

According to one aspect of the invention there is provides a belt for a material web producing machine, which includes a plurality of long-chain strength supports arranged to form interstices, and a filler at least partially filling the interstices. The belt may be used to support a paper web in the web producing machine. The long-chain strength supports may include a metal having a high thermal conductivity. The metal may be one of stainless steel and bronze. The long-chain strength supports may be filaments. The filaments may be a metal.

The invention provides that the long-chain strength supports may be of many shapes. They may be substantially circular in cross-section, substantially rectangular cross-section, substantially square in cross-section, substantially oval in cross-section, or have a polygonal cross-section. Moreover, the belt may utilize any combination of these shapes. Further, the belt may utilize many different sizes which are combined together. The long-chain strength supports may also be of a variable cross-sectional shape along their lengths.

The invention further provides that the filler may be a plastic. That the belt may be at least substantially impermeable to a fluid, such as a liquid. The belt may utilize beadlike protuberances located at peripheral regions. The beadlike protuberances may be formed by the long-chain strength supports. The beadlike protuberances may be formed by the woven long-chain strength supports, at least one additional material mixture, and the filler.

The belt may have a surface which substantially includes the long-chain strength supports. The belt may be impermeable to a fluid. The belt may include a smooth surface which substantially includes the long-chain strength supports covering the filler. The belt may be a screen. The screen may be flexible and formed of the woven long-chain strength supports. The belt may be an interwoven sheet of the long-chain strength supports.

The invention also provides for a process for producing a belt, which includes forming a sheet from a plurality of long-chain strength supports, the sheet including a plurality of interstices disposed between the long-chain strength supports, and filling at least a portion of the interstices with a filler. The filler may be a plastic. The long-chain strength supports may be a metal. The filling may also include dipping the sheet into a liquid filler. The filling may alternatively provide for spraying the sheet with a liquid filler. The process may include smoothing at least one surface of the sheet after filling the sheet. The filler may be a liquid. The smoothing may include treating the at least one surface to remove a portion of the filler. The treating may include grinding the at least one surface. The process may include scraping at least one surface of the sheet after filling the sheet. The scraping may be removing a portion of the filler from the at least one surface. The process may further include weaving the long-chain strength supports. The weaving density may be adjustable based upon a desired surface requirement. The process may include guiding a paper web on the belt.

According to another aspect of the invention, there is provided a belt for guiding a material web, which includes a woven metal screen, the woven metal screen including metal filaments running in a longitudinal direction, the metal filaments crossing one another so as to form interstices, and a filler which at least partially fills the interstices. The belt may also include at least two filaments disposed within the interstices and running substantially perpendicular to the longitudinal direction. The metal may be stainless steel.

The process for producing a belt, may include forming a sheet from a plurality of metal filaments running in a longitudinal direction, the sheet including a plurality of interstices disposed between filaments, disposing metal filaments perpendicular to the longitudinal direction and within the interstices, filling at least a portion of the interstices with a plastic filler, scraping a portion of the filler from at least one surface of the sheet to expose the metal filaments. The process may also include curing the filler, and grinding the at least one surface.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted drawing by way of a non-limiting example of an exemplary embodiment of the present invention, and wherein:

The FIGURE partially shows a belt in a side view section according to an exemplary embodiment of the invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The belt 10 according to the invention depicted in the figure includes a flat metal fabric made of intertwined metallic fibers 12, 14, 16 as strength supports which are preferably made of stainless steel or bronze. In principle, even filaments made of various metals can be processed according to the invention to form a belt.

The cross-sectional shape of the strength supports can be freely chosen in principle, such that the cross section over the length of the strength supports can be constant as well as variable. The strength supports exhibit an approximately circular cross section, for example, but can also have a strip-like or band-like shape, for example, and can exhibit a cross section in the shape of a flat rectangle with rounded edges, for example. Mixed cross-sectional shapes of the strength supports within a belt 10 are also possible according to the invention.

In the embodiment shown, fibers or filaments 16 run two at a time through partitions formed by fibers or filaments 12, 14 which run perpendicular thereto. In principle, any given weaving process can be used according to the invention in order to manufacture from metallic filaments or narrow strips or bands 12, 14, 16 a sheetlike sheet material having the desired width.

A plastic material 18 is present as filler in the interstices between individual filaments 12, 14, 16, with filaments 12, 14, 16 serving as supports for plastic material 18. In the sectional plane illustrated, the surfaces of the belt 10 are formed from filaments 12, 14 which run horizontally in the figure. In each of the partitions defined by filaments 12, 14, filaments 16, which run two at a time, can be imbedded in the plastic material 18 such that an inner connection, formed between filaments 16 and plastic material 18, is guaranteed by the liquid impermeability of belt 10. However, belt 10 according to the invention can also be manufactured such that liquid impermeability is assured even without an inner connection between the strength supports and the plastic material and, in fact, is achieved by a self-sealing effect arising from exertion of pressure from flat belts.

In principle, the manner in which a sheet material having interstices formed from strength supports, in particular metallic filaments, is manufactured may be freely chosen, depending in particular on the desired properties. Preferably, however, a flat metal fabric is prepared from metallic filaments by a weaving process in which the weaving method of this fabric is chosen corresponding to the respective requirements.

The metallic filaments can thus be processed or interwoven with one another such that the sheet material exhibits a substantially sealed metallic surface, between which the filler, in particular plastic, is placed. As a result, the amount of filler or plastic on the overall surface of the belt is very small or negligible.

In order to manufacture belt 10 according to the invention, metallic filaments 12, 14, 16 are first interwoven with one another according to the particular weaving process, in order to produce the metallic sheet material which to some degree serves as a skeleton for belt 10. This metal fabric is subsequently dipped into a bath of liquid plastic in order to fill the interstices in the fabric.

After removal from the dip bath, plastic material, which covers the surfaces of the metal fabric now filled with plastic, is removed in order to create metallic polished surfaces. To this end, the plastic, which is preferably still liquid, can be removed by scraping, for example, or by scraping in the interstices near the surface. The surfaces can be smoothed thereby. In this manner, care is taken that the amount of metallic filaments 12, 14, 16 on the overall surface of the belt, which is determined by the particular weaving process, is still present following the plastic treatment and curing of the plastic. In an additional process step, belt 10 can undergo final treatment, for example, by grinding of the belt surface.

Although the previously described use of a plastic dip bath represents the preferred procedure, an alternative option for placing plastic into the interstices would involve spraying the metal fabric with liquid plastic and then, if desired, removing the plastic covering from the surfaces in order to expose the metallic filaments.

The preferred application of the belt according to the invention provides for the use of the sealing belt in the drying areas of paper machines. To this end, the sheetlike sheet material can be manufactured such that beadlike protuberances are present which protrude at least in one direction into the peripheral regions (not shown in the figure).

These sealing beads can be produced, for example, by intertwining metallic filaments, thereby being formed at the same time by processing of the sheet fabric. It is also possible to form the sealing beads using the plastic material lying on the surface of the sheet fabric. The sealing beads can also include another material which is used neither for the strength supports nor for the filler, or a material mixture or compound material.

The belt according to the invention is transported to a drying device of a paper machine, for example, to a drying cylinder which has a heatable surface, together with the paper web to be dried and one or several screens, such that the belt, the two sealing beads of the belt, and the heated surface of the drying cylinder delimit a drying space which extends over a portion of the circumference of the drying cylinder. The paper web to be dried and the screens are located in this drying space. The paper web can lie directly on the drying cylinder, whereas the screens are arranged between the paper web and the sealing belt according to the invention. Depending on the width of the belt, the lateral sealing beads of the belt lie either directly on the drying cylinder or on one of the screens which lie on the cylinder surface.

Because of the liquid impermeability of the compound material according to the invention, the moisture which vaporizes from the paper web cannot escape from the drying space sealed off by the belt. The good thermal conductivity of the belt assures rapid heat removal, such that the moisture at the screen condenses and is carried away from the drying area by this thermal conductivity.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Belt
12, 14 Metallic filaments
16 Metallic filaments
18 Plastic material

The invention claimed is:

1. A belt for a material web producing machine, comprising:

a plurality of long-chain strength supports composed of a metallic material and arranged to form interstices; and a filler at least partially filling the interstices to make said belt fluid impermeable.

2. The belt of claim 1, wherein the long-chain strength supports comprise a metal having a high thermal conductivity.

3. The belt of claim 2, wherein the metal is one of stainless steel and bronze.

4. The belt of claim 1, wherein the long-chain strength supports comprise filaments.

5. The belt of claim 4, wherein the filaments comprise a metal.

6. The belt of claim 1, wherein the long-chain strength supports comprise a substantially circular cross-section.

7. The belt of claim 1, wherein the long-chain strength supports comprise a substantially rectangular cross-section.

8. The belt of claim 1, wherein the long-chain strength supports comprise a substantially square cross-section.

9. The belt of claim 1, wherein the long-chain strength supports comprise a substantially oval cross-section.

10. The belt of claim 1, wherein the long-chain strength supports comprise a polygonal cross-section.

11. The belt of claim 1, wherein the long-chain strength supports comprise a variable cross-sectional shape along their lengths.

12. The belt of claim 1, wherein the filler comprises a plastic.

13. The belt of claim 1, wherein the fluid is a liquid.

14. The belt of claim 1, wherein the belt comprises a screen.

15. The belt of claim 14, wherein the screen is flexible and formed of woven long-chain strength supports.

16. The belt of claim 1, wherein the belt comprises an interwoven sheet of the long-chain strength supports.

17. The belt of claim 1, wherein the belt supports a paper web in the web producing machine.

18. A belt for a material web producing machine, comprising:

a plurality of long-chain metal strength supports arranged to form interstices;

a filler at least partially filling the interstices; and beadlike protuberances located at peripheral regions of the belt, wherein the belt is impermeable to a fluid.

19. The belt of claim 18, wherein the beadlike protuberances comprise woven long-chain strength supports.

20. The belt of claim 18, wherein the beadlike protuberances comprise the woven long-chain strength supports, at least one additional material mixture, and the filler.

21. A belt for a material web producing machine, comprising:

a plurality of long-chain strength supports composed of a metallic material and arranged to form interstices; and a filler at least partially filling the interstices to make said belt fluid impermeable, wherein the belt comprises a surface which substantially comprises the long-chain strength supports.

22. The belt of claim 21, wherein the belt is impermeable to a fluid.

23. A belt for a material web producing machine, comprising:

a plurality of long-chain strength supports composed of a metallic material and arranged to form interstices; and a filler at least partially filling the interstices to make said belt fluid impermeable, wherein the belt comprises a smooth surface which substantially comprises the long-chain strength supports covering the filler.

24. A process for producing a belt, comprising:

forming a sheet from a plurality of long-chain strength supports composed of a metallic material, the sheet comprising a plurality of interstices disposed between the long-chain strength supports;

filling at least a portion of the interstices with a filler, whereby the sheet is made fluid impermeable to form a sealing belt for a dryer device in a paper machine; and at least one surface of the sealing belt is formed to expose at least a portion of the metallic material.

25. The process of claim 24, wherein the filler comprises a plastic.

26. The process of claim 24, wherein the long-chain strength supports comprise a metal.

27. The process of claim 24, wherein the filling further comprises:

dipping the sheet into a liquid filler.

28. The process of claim 24, wherein the filling further comprises:

spraying the sheet with a liquid filler.

29. The process of claim 24, further comprising:

smoothing at least one surface of the sheet after filling the sheet.

30. The process of claim 29, wherein the filler comprises a liquid.

31. The process of claim 29, wherein the smoothing comprises:

treating the at least one surface to remove a portion of the filler.

32. The process of claim 31, wherein the treating comprises grinding the at least one surface.

33. The process of claim 24, further comprising:

scraping at least one surface of the sheet after filling the sheet.

34. The process of claim 33, wherein the scraping comprises removing a portion of the filler from the at least one surface.

35. The process of claim 24, wherein the forming further comprises:

weaving the long-chain strength supports.

36. A process for producing a belt, comprising:

forming a sheet from a plurality of long-chain strength supports composed of a metallic material, the sheet comprising a plurality of interstices disposed between the long-chain strength supports, the forming comprising weaving the long-chain strength supports; and filling at least a portion of the interstices with a filler, whereby the sheet is made fluid impermeable, wherein the weaving density is adjustable based upon a desired surface requirement.

37. A sealing belt for a dryer in a machine for producing a material web, comprising:

a flexible woven metal screen;

the woven metal screen comprising metal filaments running in a longitudinal direction, the metal filaments crossing one another so as to form interstices; and a filler which at least partially fills the interstices to form a fluid impermeable screen.

38. The belt of claim 37, further comprising at least two filaments disposed within the interstices and running substantially perpendicular to the longitudinal direction.

39. The belt of claim 38, wherein the metal comprises stainless steel.

40. The belt of claim 37, wherein, on at least one surface of said belt, at least a portion of said metal filaments are exposed.

41. The belt of claim 37, wherein, prior to a curing of said filler, a portion of said filler is scraped from at least one surface of said fluid impermeable belt to expose a least a portion of said metal filaments.

42. The belt of claim 37, wherein, prior to a curing of said filler, a portion of said filler is scraped from at least one surface of said fluid impermeable belt to provide a smooth surface, and, after said curing of said filler, said smooth surface is ground to expose a least a portion of said metal filaments.

43. The belt of claim 37, wherein, after a curing of said filler, a portion of said filler is ground from at least one surface of said fluid impermeable belt to expose a least a portion of said metal filaments.

44. The belt of claim 37, wherein, after filling the interstices, at least a portion of said metal filaments are exposed on at least one surface of said fluid impermeable belt, and the filler is subsequently cured.

45. A process for producing a belt, comprising:

forming a sheet from a plurality of metal filaments running in a longitudinal direction, the sheet comprising a plurality of interstices disposed between filaments;

disposing metal filaments perpendicular to the longitudinal direction and within the interstices;

filling at least a portion of the interstices with a plastic filler;

scraping a portion of the filler from at least one surface of the sheet to expose the metal filaments.

46. A process for producing a belt, comprising:

forming a sheet from a plurality of metal filaments running in a longitudinal direction, the sheet comprising a plurality of interstices disposed between filaments;

disposing metal filaments perpendicular to the longitudinal direction and within the interstices;

filling at least a portion of the interstices with a plastic filler;

scraping a portion of the filler from at least one surface of the sheet to expose the metal filaments;

curing the filler; and grinding the at least one surface.

47. A sealing belt for a dryer in a machine for supporting a material web, comprising:

a flexible woven metal screen;

the woven metal screen comprising metal filaments running in a longitudinal direction, the metal filaments crossing one another so as to form interstices; and a filler which at least partially fills the interstices to form a fluid impermeable screen.

48. A belt for a material web producing machine, comprising:

a plurality of long-chain strength supports composed of a metallic material and arranged to form interstices; and a filler at least partially filling the interstices to make said belt fluid impermeable, wherein said fluid impermeable screen is structured as a sealing belt for a dryer device to support a material web.

49. A process for producing an impermeable belt, comprising:

applying a plastic filler to a woven metal screen to form a belt that is impermeable to a fluid; and removing the plastic filler from both sides of the belt to expose the metal filaments on the both sides, wherein the metal filaments transfer heat through the belt.

50. The process of claim 49, further comprising grinding at least one of the both sides.

51. The process of claim 49, further comprising forming beadlike protuberances at peripheral regions of the belt.

* * * * *